United States Patent [19]

Mineo

[11] 4,020,976

[45] May 3, 1977

[54] TOOTHPASTE HOLDER AND DISPENSER COMBINATION

[76] Inventor: Joseph S. Mineo, 22119 Runnymeade, Canoga Park, Calif. 91303

[22] Filed: June 5, 1975

[21] Appl. No.: 584,107

[52] U.S. Cl. ..... 222/103

[51] Int. Cl.[2] ..... B65D 35/28

[58] Field of Search ..... 401/155, 158; 222/95, 222/97, 101, 103, 105, 96

[56] References Cited

UNITED STATES PATENTS

| | | | |
|---|---|---|---|
| 2,064,111 | 12/1936 | Hartland | 222/103 |
| 2,260,346 | 10/1941 | Spencer | 222/103 |
| 2,530,327 | 11/1950 | Derrick | 222/101 |
| 3,371,824 | 3/1968 | Goss | 222/105 |

FOREIGN PATENTS OR APPLICATIONS

| | | | |
|---|---|---|---|
| 691,579 | 10/1930 | France | 222/103 |

*Primary Examiner*—Stanley H. Tollberg
*Assistant Examiner*—H. Grant Skaggs

[57] ABSTRACT

A toothpaste holder and dispenser combination is disclosed herein having a housing supporting a slidable member on the front wall thereof and a sloping surface on the rear wall thereof. An angular chamber is defined between the opposing wall surfaces for insertably receiving a tube of toothpaste. The slidable member or actuator is forcibly urged against the tube so as to be operable to close upon the tube against the rear sloping wall to effect a controlled and progressive discharge of toothpaste from the nozzle of the tube. A cap is resiliently carried on the housing normally biased to close the nozzle of the tube.

4 Claims, 4 Drawing Figures

Fig. 2
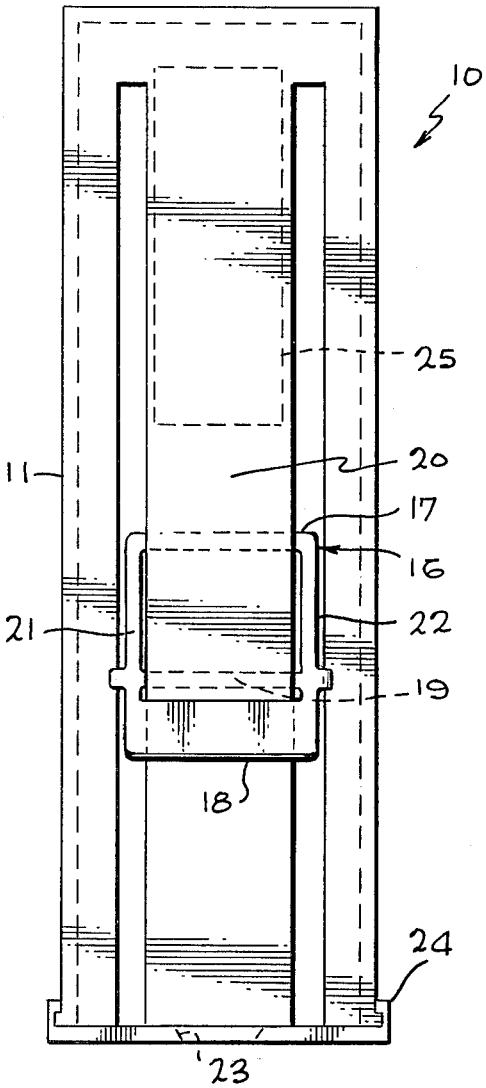
Fig. 3
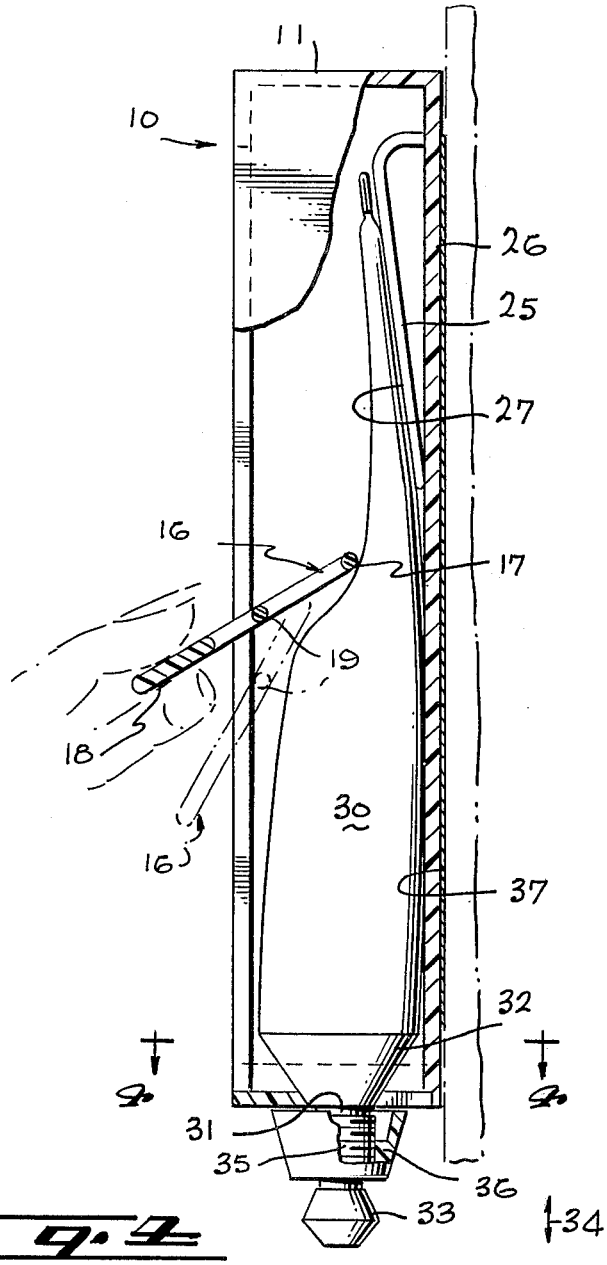
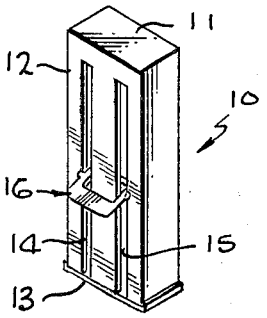
Fig. 1
Fig. 4
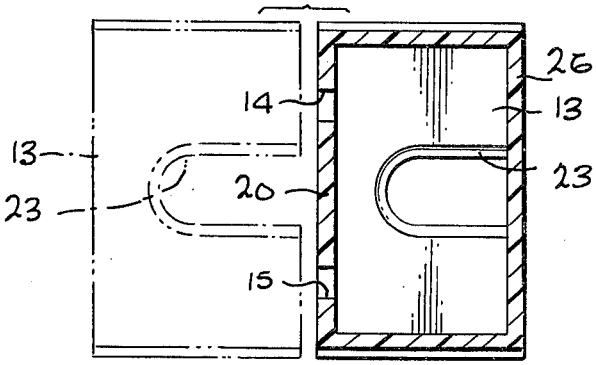

TOOTHPASTE HOLDER AND DISPENSER COMBINATION

BACKGROUND OF THE INVENTION

1. Field of the Invention

This invention relates to devices for holding toothpaste tubes and, more particularly, to a novel toothpaste holder and dispenser for effectively squeezing a tube between a slide actuator and a sloping wall to forcibly urge a controlled quantity of toothpaste to be discharged from the nozzle of the tube.

2. Description of the Prior Art

It has been the conventional practice for many years to package toothpaste in a pliable or deformable tube which is manually squeezed to cause the toothpaste to issue from the dispensing nozzle thereof. Although this is a convenient packaging means for storing the toothpaste and for removing the toothpaste from the tube, many problems have been encountered which stem largely from the fact that most persons squeeze the tube between their fingers at the top of the tube and consequently, large amounts of toothpaste reamin in pockets at the base of the tube and are never used. Also, there is no effective way to control the discharge other than applying finger grip pressure to the tube during the squeezing thereof. Even if the user rolls the base of the tube towards its nozzle end as usage proceeds, such a rolling method usually rolls over the pockets of toothpaste and does not completely assure the user that all of the toothpaste in the tube has been removed. Consequently, a good quantity of toothpaste which is available to the user is discarded when the tube is thrown away.

Some attempts have been made to provide automatic devices for expelling or discharging toothpaste from a tube which generally involves the principle of using a turn key or clip which is attached at the base of the tube and, upon twisting of the key, the base of the tube rolls toward the discharge end to effect issuance of the toothpaste from the nozzle. Difficulties have been found when employing these devices which stem from the fact that the material of the tube is very soft and pliable and creases, cracks and openings generally occur along the edges of the tube as it is collapsed through which toothpaste issues. This is considerably messy and the cracks or openings widen as the turn key is subsequently used so that the toothpaste issues through these openings rather than through the nozzle.

Other attempts include tube squeezing devices such as disclosed in U.S. Pat. Nos. 2,830,736; 2,841,310 and 2,766,908. These devices include a slide member that is urged against the tube forcing the tube against a rear wall of a housing to expel the tube contents. Disadvantages have been encountered due to the extreme applied loads carried by the slide member and the necessity for the user to push inward and downward simultaneously. These movements can only be judged by feel since the user cannot see the tube and cannot accurately judge how much of the tube contents is remaining or is captured in pockets of the tube.

Therefore, there has been a long standing need to provide a novel toothpaste dispenser that will not rupture the material of the tube and will assure, when actuated, that all of the toothpaste has been progressively moved through the tube and out of the tube through the nozzle.

SUMMARY OF THE INVENTION

Accordingly, the above difficulties and problems encountered with prior toothpaste dispensers are obviated by the present invention which provides a novel toothpaste dispenser having a housing for supporting a front wall and a rear wall supporting a rearwardly sloping pressure surface. The opposing walls provide an angular chamber between their opposing wall surfaces for receiving a tube of toothpaste. The base of the tube lies within a tapered aperture at the bottom of the housing and the discharge nozzle of the tube rests through the aperture or opening in the bottom of the housing which serves as a pressure plate against which the tube of toothpaste is supported. An acutator means is slidably carried on the housing and is operably coupled to the front wall thereof for reducing the angle betweeen the opposing actuation means and sloping pressure surface. The opposing surface grip and apply a converging pressure against the opposite sides of the tube to progressively expel the contents thereof through the nozzle and opening in the bottom of the housing.

By employing the means of the present invention, rolling of the tube carrying the toothpaste is not required and all of the toothpaste carried in the tube is discharged through the nozzle with applied loads being transmitted into the rear wall of the housing and then into the supporting mounting wall.

Therefore, it is among the primary objects of the present invention to provide a novel toothpaste dispenser employing a squeezing pressure along the entire length of the tube of toothpaste to forcibly urge the toothpaste from its discharging nozzle.

Another object of the present invention is to provide a novel toothpaste dispenser having an acutator means operable to converge the opposite sides of the toothpaste tube without the necessity of rolling or otherwise deforming the tube in order to expel its contents.

Still another object of the present invention is to provide a novel toothpaste dispenser having a housing for supporting means for squeezing a tube of toothpaste to progressively expel its contents and for transferring applied load forces into surrounding structure.

Yet another object of the present invention is to provide a novel toothpaste dispensing device for enclosing and supporting a tube of toothpaste which includes actuating means for squeezing the opposite sides of the tube to expel the contents thereof.

BRIEF DESCRIPTION OF THE DRAWINGS

The feature of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view of the novel toothpaste holder and dispenser of the present invention;

FIG. 2 is an enlarged front elevational view of the dispenser;

FIG. 3 is a longitudinal cross sectional view of the dispenser showing the tube partially collapsed by the actuator; and FIG. 4 is a transverse cross sectional view of the dispenser as taken in the direction of arrows 4—4 of FIG. 3.

DESCRIPTION OF THE PREFERRED EMBODIMENT

Referring now to FIG. 1, the novel toothpaste holder and dispenser of the present invention is illustrated in the general direction of arrow 10 which includes a box-like housing 11 having a removable front wall 12 and a bottom 13 which supports the tube of toothpaste. The front wall is provided with a pair of parallel slots 14 and 15 through which a slide member or actuator 16 moves in a vertical direction under control of the user's hand. In general, the actuator 16 is near the top of the housing when a full tube of toothpaste is included in the housing. As the slider or actuator 16 is moved downward, toothpaste is expelled from the nozzle carried on the bottom 13.

Referring now in general to FIG. 2, it can be seen that the slider 16 is of a square shape and is composed of a tubular construction which includes a toothpaste tube engaging portion 17, a finger engaging portion 18 and an intermediate cross portion 19. The front wall 12 includes a central strip 20 which is disposed against the front of the intermediate portion 19 of the actuator 16. This construction maintains the actuator on the front wall 12 and provides that the portion 18 project outwardly from the front face of the housing as shown in FIG. 1 so that it is within ready grasp of the user. The portions 17, 18 and 19 are fixedly held together by the side portions 21 and 22 so that a single piece or unitary actuator is provided.

It can also be seen in FIG. 2 that the bottom 13 includes a tapered aperture 23 which receives the nozzle portion of the tube. The bottom 13 further includes a sliding attachment means indicated by numeral 24 which slidably holds the bottom 13 in place. By removing the bottom wall, an old toothpaste tube may be removed and a new or fresh tube may be inserted therein. FIG. 2 also discloses that a downwardly sloping pressure plate 25 is carried on a rear wall 26 of the housing 11.

As shown more clearly in FIG. 3, the pressure plate 25 includes a downwardly and rearwardly sloping surface 27 against which the toothpaste tube 30 rests. The opposite side wall of the toothpaste tube 30 is engaged by the tube engaging portion 17 of the actuator 16. Therefore, it can be seen that the user may grasp the portion 18 in his fingers and forcibly urge portion 17 against the tube and by sliding the keeper downward wherein intermediate portion 19 engages with the central wall 20 of the front wall 12, contents of the tube is forcibly urged from its nozzle 31. It is to be particularly noted that the actuator 16 does not require a separate guide means since engagement of the portion 19 with the interior surface of the wall portion 20 maintains the actuator in proper position. The user may somewhat rotate the actuator about portion 19 to assist in urging the contents from the tube to be forced through the nozzle 31.

FIG. 3 further shows that the base of the tube 32 rests on the bottom 13 and that the nozzle 31 is provided with a cap 33 that may be moved upward or downward such as is indicated by the arrows 34. When the cap is moved up, the nozzle is closed and when the cap is moved down the nozzle is opened. Such construction is conventional and does not form a part of the present invention. This conventional closure is attached to the nozzle 31 by a screw cap 35 having a skirt 36 carried thereon. The skirt includes a peripheral edge which bears against the bottom 13 to properly support the tube within the housing 11.

Referring to FIG. 4, it can be seen that the tube 30 may be readily inserted for replacement or taken out when used by merely sliding the bottom 13 outwardly as shown in broken lines. The aperture 23 is elongated and it will readily fit about the base 32 of the tube when the tube is within the interior of the housing.

In view of the foregoing, it can be seen that the novel toothpaste holder and dispenser of the present invention provides a housing 11 which includes an internal chamber that is angular due to the downwardly sloping surface 27 of pressure plate 25 and that the opposing front wall surface 12 is flat. By moving the actuator 16 downward so that portion 17 pushes against the tube and forces the tube against the sloping surface 27, the contents of the tube is expelled through the nozzle 31 and closure 33 when the closure is open. The forces applied to the tube and the sloping surface 27 are transmitted through the rear wall 26 into the mounting wall structure or surface 37 as shown in FIG. 3. Limited horizontal movement is given to the actuator 16 since the actuator may be moved into and out of the chamber within the limits defined by engagement of intermediate portion 19 with wall portion 20 and engagement with portion 17 with the wall portion 20. The actuator 16 may be pivoted about intermediate portion 19 as shown in broken lines in FIG. 3 to assist in expelling the contents from the tube.

The device of the present invention is relatively inexpensive to manufacture and may be used by children as well as adults since the device is not complex in construction.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A toothpaste holder and dispensing device for squeezing the contents of a pliable tube through a nozzle comprising the combination of:

a housing having a back member and side walls projecting forward of said back member in fixed spaced apart relationship terminating along their edges in connection with a front wall;

a pressure plate carried on said back member and provided with a downwardly and rearwardly sloping surface wherein an angular chamber is defined between the opposing surfaces of said front wall and said pressure plate;

an actuator slidably carried on said frontwall having a finger grasping portion and a tube engaging portion;

said actuator further having a guide means cooperating with said front wall for retaining said actuator in sliding relationship therewith which includes a pair of parallel slots provided in said front wall defining a central strip therebetween and said actuator further including a pair of side members joining said finger grasping portion to said tube engaging portion wherein said side members are slidably disposed and carried through said pair of slots respectively;

said guide means further includes an intermediate portion interconnecting said pair of side members midway between said fingers grasping portion ans said tube engaging portion;

said intermediate separating and defining a pair of openings wherein said central strip passes through said opening between said intermediate portion and said finger engaging portion;

said angular chamber is occupied by said tube and said actuator is manually operable towards and away from said tube to controllably depress and collapse said tube against said sloping surface of said pressure plate;

said housing includes a removable bottom having an open ended slot for receiving and supporting the base of said tube so as to stand in an inverted position; and a threaded member detachably engageable with said tube nozzle and further a skirt carried on said threaded member bearing against the underside of said bottom for holding said tube in said inverted position.

2. The invention as defined in claim 1 wherein said pressure plate is critically located in the upper half of said angular chamber.

3. The invention as defined in claim 2 wherein said actuator pivots about its engagement of said intermediate portion with said central strip.

4. The invention as defined in claim 3 wherein said housing is composed of transparent material for visual observation of said tube within said angular chamber.

* * * * *